US011370569B2

(12) United States Patent
Bocedi et al.

(10) Patent No.: US 11,370,569 B2
(45) Date of Patent: Jun. 28, 2022

(54) MACHINE FOR WRAPPING PALLETS

(71) Applicant: OFFICINA BOCEDI S.R.L., Scandiano (IT)

(72) Inventors: Stefano Bocedi, Reggio Emilia (IT); Federico Busato, Rio Saliceto (IT)

(73) Assignee: OFFICINA BOCEDI S.R.L., Scandiano (IT)

( * ) Notice: Subject to any disclaimer, the term of this patent is extended or adjusted under 35 U.S.C. 154(b) by 0 days.

(21) Appl. No.: 17/121,250

(22) Filed: Dec. 14, 2020

(65) Prior Publication Data

US 2021/0188467 A1 Jun. 24, 2021

(30) Foreign Application Priority Data

Dec. 19, 2019 (IT) ..... 102019000024781

(51) Int. Cl.

| | |
|---|---|
| ***B65B 41/12*** | (2006.01) |
| ***B65B 11/02*** | (2006.01) |
| ***B65B 51/10*** | (2006.01) |
| ***B65B 61/06*** | (2006.01) |

(52) U.S. Cl.

CPC ..... *B65B 11/025* (2013.01); *B65B 41/12* (2013.01); *B65B 51/10* (2013.01); *B65B 61/06* (2013.01)

(58) Field of Classification Search

USPC ..... 53/203

See application file for complete search history.

(56) References Cited

U.S. PATENT DOCUMENTS

| | | | | |
|---|---|---|---|---|
| 4,724,658 | A | 2/1988 | Birkenfeld et al. | |
| 9,878,814 | B2 | 1/2018 | Geerts et al. | |
| 10,407,193 | B2 | 9/2019 | Bocedi et al. | |
| 2002/0170270 | A1 * | 11/2002 | Borchard | B65B 9/135 53/432 |

(Continued)

FOREIGN PATENT DOCUMENTS

| | | | |
|---|---|---|---|
| EP | 0184485 | B1 | 1/1989 |
| EP | 0250647 | B1 | 10/1989 |

(Continued)

*Primary Examiner* — Chinyere J Rushing-Tucker

(74) *Attorney, Agent, or Firm* — Pearne & Gordon LLP

(57) ABSTRACT

Machine for wrapping pallets (P) by means of a stretchable film cap, comprising: a main frame (1) which defines a working area (A) of the machine; a traction device (2), arranged to lower the film cap by fitting it onto the pallet (P); a feeder device (3) arranged to feed the film to the traction device (2); a cutting and welding device (4) of the film, arranged to cut and weld the film so as to obtain a cap closed at one end thereof.

The feeder device (3) is movable along the frame (1) between an operating position, located above the main frame (1), and a service position, in which said feeder device is located at a given height from the ground, on one side of the main frame (1).

The feeder device (3) comprises two diverters (31), each of which is structured to grip two adjacent corners (C) on opposite sides of the film, and to move the corners away from one another.

The diverters (31) are movable on an area outside of the main frame (1) along guides (11,12), structured to maintain the feeder device (3) outside the main frame (1) and the working area (A), during the displacement between the working position and the service position.

15 Claims, 7 Drawing Sheets

(56) References Cited

U.S. PATENT DOCUMENTS

| | | | | |
|---|---|---|---|---|
| 2007/0051075 | A1* | 3/2007 | Chiu Chen | B65B 9/135 53/504 |
| 2009/0293435 | A1* | 12/2009 | Johnson | B65B 11/00 53/461 |
| 2014/0230380 | A1 | 8/2014 | Geerts et al. | |
| 2017/0057677 | A1* | 3/2017 | Terenzi | B65B 45/00 |
| 2017/0073092 | A1* | 3/2017 | Bocedi | B65B 41/16 |

FOREIGN PATENT DOCUMENTS

| | | | |
|---|---|---|---|
| EP | 2767479 | B1 | 4/2016 |
| EP | 3144233 | B1 | 8/2018 |
| EP | 3459868 | | 3/2019 |
| RU | 2412876 | C2 | 2/2011 |
| WO | 2015140310 | A1 | 9/2015 |

* cited by examiner

MACHINE FOR WRAPPING PALLETS

The present invention relates to a machine for wrapping pallets.

In particular, the present invention relates to a machine predisposed to fit a cap of stretchable film onto a stack of articles arranged on a pallet.

The machines currently available for wrapping pallets by means of a cap of stretchable film comprise a frame, which mainly extends vertically, with which a device for feeding the film, a device for cutting and welding the film, and a device for positioning the film are associated.

The film feeder device takes a section of tubular stretchable film from a storage, typically realised in the form of a wound roll of the film. The section of film is normally taken by unwinding from the storage.

The cutting and welding device, positioned beneath the feeder device, is predisposed to cut and weld the film, so as to obtain a cap closed at one end thereof.

The film positioning device, positioned beneath the cutting and welding device, is predisposed for gripping the lower edges of the film cap and for lowering the cap itself, fitting it onto the stack of articles beneath.

The machines currently available are divided substantially into two types. In a first type of machine, all the operating devices briefly described above are associated with the upper part of the frame, which may reach considerable heights. This implies the need to provide access ladders or stairs and walkways to the upper part of the frame in order to allow intervention operations on the operating devices themselves, for example to feed the head of a new stretchable film reel to the feeder device. Said access stairs or ladders and walkways require appropriate safety measures to be adopted, often obligatory, to prevent accidental falling of operators.

In a second type of machine, the operating devices briefly described above are provided with the possibility of sliding vertically along the machine frame, being able to lower substantially to ground level to allow performance of maintenance operations on the ground.

An example of a machine of the second type is known from document EP2767479. The machine described in this document comprises a main frame defined by four uprights superiorly joined by a plurality of cross-members. An upper frame, which bears both the feeder device and the cutting and welding device, is vertically slidingly associated to the main frame. The upper frame is further may further be able to assume an operating configuration, in which it is orientated in a horizontal position, and a service configuration, in which it is orientated in a vertical position on a side of the main frame. In the service position the feeder device and the cutting and welding device are substantially within easy reach for a person, so that any maintenance operations can be carried out from a ground position.

In the machine briefly described in the foregoing, and in other machines of the same type, the upper frame cannot assume the service position if a pallet is present in the machine. In other terms, in order to bring the upper frame into the service position it is necessary for the work space delimited by the main frame to be unoccupied. This implies that in the case where a need emerges for an intervention on the upper frame during the wrapping of a pallet, the operations are inevitably suspended and the pallet must be moved away from the machine, with consequent waste of time and material. Further, the structure and mechanisms necessary for the movement of the upper frame are rather complex and expensive.

Another example of known type of machine is disclosed in patent EP3459868. This machine also has a main frame defined by four uprights superiorly joined by a plurality of cross-members. An upper carriage, which bears both the feeder device and the cutting and welding device, is vertically slidingly associated to the main frame. The movement of the upper carriage is achieved by means of the positioning device which, when required, climbs up the frame until it meets and hooks the upper carriage. Once hooked, the upper carriage moves vertically solidly constrained with the positioning device. In this machine, whenever it is necessary to intervene on the feeder device, the positioning device must be maneuvered and both the feeder device and the cutting and welding device must be lowered to an accessible position. The operations are therefore quite complex, as they require the displacement of many parts of the machine.

The aim of the present invention is to provide a machine for wrapping pallets which allows the drawbacks summarised above to be obviated.

An advantage of the machine according to the present invention is to allow access to the feeder device in a simple and effective manner, without requiring the displacement of other working groups.

Another advantage of the machine according to the present invention is that it allows access to the feeder device even in the presence of a loaded pallet in the machine.

Additional features and advantages of the present invention will become more apparent from the following detailed description of one embodiment of the invention, illustrated by way of non-limiting example in the appended figures in which.

Figure 10:
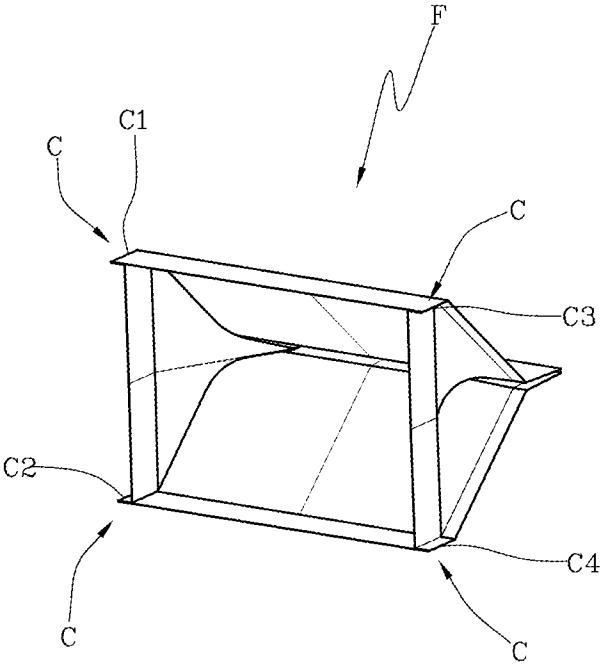
Figure 9:
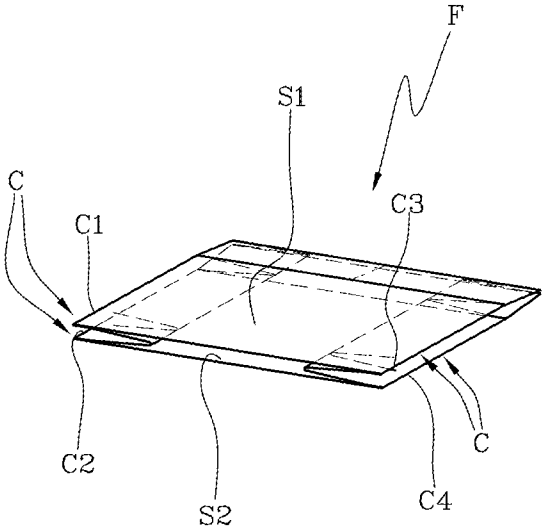

FIGS. 9 and 10 schematically show a portion of film (F) in a flattened configuration and in a widened configuration respectively.

The machine according to the present invention comprises a main frame (1) which delimits a working area (A) of the machine. The working area (A) of the machine is substantially the space in which the pallet to be wrapped is located and in which the machine carries out the wrapping.

The main frame (1) comprises a bearing structure, destined to be supported and fixed on a base or on the ground. In a preferred embodiment, the main frame (1) comprises one or more upper cross-members (1*a*), for example a pair of upper cross-members (1*a*) which are parallel to one another. The frame further comprises one or more uprights (1*b*), for example a pair of uprights (1*b*) parallel to one another and connected to the upper cross-members (1*a*). The main frame (1) preferably comprises two pairs of uprights (1*b*), each of which is connected to a respective end of the upper cross-members (1*a*). The uprights and the cross-members can be connected to one another by means of further uprights or cross-members (not described in detail) with the aim of increasing the rigidity of the main frame (1). The cross-members and the uprights of the main frame (1) define a bearing structure which internally delimits the working area (A).

The machine further comprises a traction device (2), predisposed for lowering the cap of film to fit it onto the pallet (P). This traction device (2), in substance, grips the end of the film (F) from below, widens it out into a tubular configuration and lowers the film to fit it onto the pallet.

The film (F) is fed to the traction device (2) by means of a feeder device (3), located above the traction device (2).

The feeder device (3) receives the film (F) in input in a flattened configuration, illustrated in FIG. 9. In said flattened configuration, the tubular film is substantially arranged in two main layers (S1,S2) superposed and joined laterally by two side portions folded in bellows fashion. The junction areas between the side portions and the main layers are corners (C) of the film, i.e., areas which are folded around straight folding lines. Therefore, in the folded bellows configuration the film (F) has four corners (C) flanked to each other two by two. In essence, two corners (C1,C2) are flanked to each other and opposite the other two corners (C3,C4).

The film (F) is wrapped in a roll, defining a storage (M1,M2 . . . ). Advantageously, the illustrated machine is capable of working with at least two films (F), of different sizes, each of which is collected in a respective storage (M1,M2). From time to time, the feeder device (3) unwinds from the storage a portion of film of predetermined length, sufficient for the wrapping of the pallet.

A cutting and welding device (4) is arranged between the feeder device (3) and the traction device (2), which cutting and welding device (4) is predisposed to cut and weld the film, so as to obtain a cap closed at one end.

The functioning of the machine, in itself of known type, includes feeding a portion of film (F) of a determined length to the traction device (2), which proceeds to widen and collect in a sleeve fashion manner the portion of film (F). Once the desired length has been obtained the cutting and welding device (4) cuts the film (F) and welds the cut edges so as to obtain a cap which thereafter is lowered and fitted onto the pallet. On completion of the cycle the traction device (2) newly climbs up towards the initial position thereof in which it is supplied with a new portion of film (F) unwound from the feeder device (3) and cut by the cutting and welding device (4).

Both the traction device (2) and the cutting and welding device (4) are well known to the technical expert in the sector.

The traction device (2) comprises for example four gripping units (21), arranged substantially at the vertices of a quadrilateral. Each gripping unit (21) is movable on a horizontal plane along two perpendicular axes. The vertical motion of the traction device (2) is obtained by means of sliding of the gripping units (21) along the uprights (1*b*) of the main frame (1), operated by actuators of a known type.

Each gripping unit comprises a hooking element, predisposed to be inserted at least partially into the film below a lower edge of the film. The hooking element is for example in the form of an elongated plate, orientated vertically and shaped so as not to cause damage to the film.

The hooking element is predisposed to pull and widen the tubular film through the sliding motions of the gripping unit (21) along the horizontal sliding directions.

The gripping units (21) are initially in a position in which they are close to each other. In this position, they are raised towards the lower edge of the overlying film (F) coming from the feeder device (3). Each hooking element is positioned inside the film (F). Subsequently, the gripping units (21) are distanced from each other by sliding, until they reach the vertices of a quadrilateral. By moving away from each other, the hooking elements stretch the lower edge of the film (F) so that it is positioned in plan view according to a corresponding quadrangular shape.

Each gripping unit (21) also comprises a motorised roller, predisposed to approach the hooking element and to grip the film on the hooking element. Thus, when activated in rotation, the motorised roller collects the film between itself and the hooking element alongside it. The simultaneous action of the four motorised rollers therefore leads to total collection, along a vertical direction, of a portion of film coming from the feeder device (3). The portion of film is collected in a sleeve fashion about the hooking elements Thereafter the gripping units (21) are lowered to fit the film (F) onto the pallet. The film stretches once again in contact with the stack of articles, progressively unwinding from the hooking elements. Once the arrangement of the film on the pallet is completed, said pallet is evacuated and replaced by a new pallet to be wrapped and the gripping units (21) return to the initial position for a new cycle of operations identical to the one described.

The cutting and welding device (4) comprises a pair of operating elements, of which at least one may be heated to a melting temperature of the film. The two operating elements are mobile between a working position, in which they are alongside each other to grip a portion of the film, and a release position, in which they are distanced from each other. The two operating elements are controlled by actuators at the disposal of the person skilled in the art. The two operating elements are arranged beneath the feeder device (3) and act on the film which is still in the flattened configuration in two superimposed layers. In the working position, the heat and the pressure action exerted by the operating elements on the film, which is flattened in two superimposed layers, cause the cutting of the film and the fusion between the two layers.

The feeder device (3) comprises two diverters (31), each of which is structured to grip superposed corners of the film, and to move the corners away from one another. Essentially, the feeder device is arranged to bring the film from a flattened configuration (FIG. 9), in which the corners are superposed on each other two by two, to a widened configuration (FIG. 10), in which the corners are distanced from each other.

The diverters (31) are also vertically movable between a raised position, in which they grip the superimposed corners, and a lowered position, in which they release the corners. In the run made from the raised position to the lowered position, the diverters (31) draw the film (F) for a portion of length corresponding to the run itself.

The action carried out by the diverters (31) occurs in the following manners. Starting from an initial condition, in which the diverters (31) are in the raised position and grip the corners (C) of the film (F), the downward run is implemented, from the raised position to the lowered position. During said run, the diverters (31), which maintain the grip on the corners, draw a portion of film (F) corresponding to the length of the run, unwinding it from the storage (M1,M2). At the end of the run, or preferably during the run itself, the diverters (31) widen the corners of the film (F), arranging them substantially at the vertices of a quadrilateral and bringing the film into the widened configuration. In this widened configuration of the film (F), the traction device (2) further widens the corners, if necessary, and collects a portion of film (F) in a sleeve-like manner, which is subsequently cut and welded above by the cutting and welding device (4), in the manners already described.

From the moment the film (F) is manipulated by the traction device (2), the diverters can release the film (F) and return to the raised position, in which they grip the film (F) again at the corners. Preferably, the diverters (31) return to the raised position before the cutting and welding device (4) performs the cutting and welding of the film (F). In this manner, the gripping action of the corners of the film (F) is facilitated.

In the preferred but non-exclusive embodiment shown, each diverter (31) comprises a pair of arms (32), provided with a gripping means (33) for gripping a corner of the film. The arms (32) are movable with respect to each other between a widened position, in which they space the corners of the film, and a flanked position, in which they can grip the corners of the film (F) when it is substantially in the flattened configuration.

Preferably, but not necessarily, the arms (32) of each diverter (31) are hinged to one another at an end. When moving between the flanked position and the widened position, the arms (32) rotate about a rotation axis (Z). In an alternative embodiment, not illustrated, the arms (32) could be hinged to distinct axes, or could be movable therebetween by means of another type of kinematic mechanism.

The vertical movement of each diverter (31) is produced by means of an actuator (31*a*,31*b*). In the embodiment shown, the actuator (31*a*,31*b*) comprises a first actuator (31*a*) and a second actuator (31*b*), each of which is arranged to produce a portion of the vertical run of the diverter (31). For example, each actuator (31*a*,31*b*) is in the form of a pneumatic cylinder. In the preferred but non-exclusive embodiment shown, the arms (32) are associated with a support (34), with respect to which they are rotatable about the rotation axis (Z). The support (34) is constrained to the first actuator (31*a*), to be translated by the latter along a vertical direction. The arms (32) are further constrained to a respective guide (35) which defines a curved path on a vertical plane. The paths defined by the two guides (35) are divergent from each other from the top downwards, preferably in a mirrored manner with respect to a vertical plane. The guides (35) are integral with an intermediate support (37), to which the support (34) is also slidingly associated along a vertical direction. The intermediate support (37), in turn, is vertically movable for a portion of the vertical run carried out by the support (34), as a result of the second actuator (31*b*). In the embodiment shown, the second actuator (31*b*) is integral with the intermediate support (37).

Figure 4:
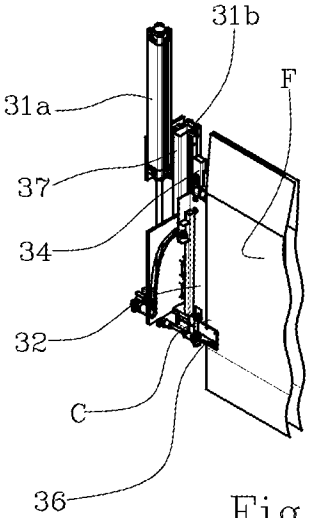

The operation of the diverters (31) occurs in the following manners. Starting from the raised position, the diverters descend towards the lowered position due to the effect of the first actuator (31*a*), for a first portion of the run downwards. In this first portion of the run, both the intermediate support (37) and the support (34) move simultaneously downwards, and the arms (32) are held in a narrowed position. At the end of the run available for the intermediate support (37) (FIG. 4), the latter stops, and therewith the guides (35), while the support (34), to which the arms (32) are integral, continues the run thereof towards the lowered position, as a result of the second actuator (31*b*). In this portion of run, following the stop of the guides (35), the arms (32), as they descend, move towards the widened position, due to the sliding along the guides (35) which, as already mentioned, are divergent. In the embodiment shown, the guides (35) are in the form of arcuate grooves, obtained through a plate (35*a*) integral with the intermediate support (37). The arms (32) are each constrained to the guide (35) thereof by means of a slider (32*a*), engaged to the respective guide (35). For example, the cursor (32*a*) is in the form of a roller or a wheel.

In an alternative embodiment, not illustrated, the rotation of the arms (32) can be achieved by other means, within the reach of those skilled in the art.

Each gripping means (33) comprises a presser (36), associated with a respective arm (32) and movable between an active position, in which it retains a corner (C) of the film (F) on the arm (32), and an inactive position, in which it does not retain the corner. The presser (36) is hinged to the arm (32) about an axis of rotation with respect to which it rotates between the active position and the inactive position. The film (F1,F2), from the storage (M1,M2), is fed to the diverters (31) from above, following a path defined through a series of rollers and/or return profiles, in a manner known in the art.

Figure 5:
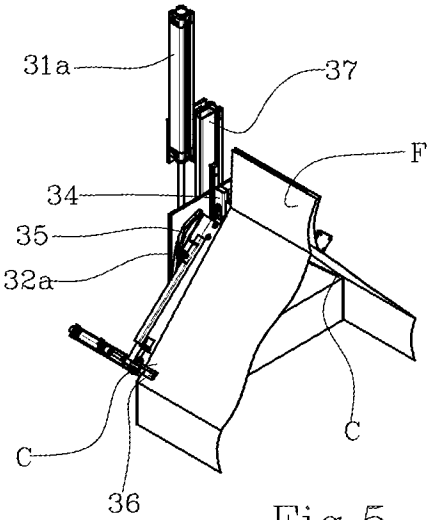
FIGS. 3, 4 and 5 show a diverter (31) of the machine according to the present invention, in three different working configurations.

The work cycle of the diverters (31) occurs in the following manners, starting from an initial condition in which the diverters (31) are in the raised position and the pressers (36) are in the inactive position. In the normal operation of the machine, in this initial condition the film (F) is in a flattened configuration, with the corners (C) positioned between a respective presser (36) and the related arm (32). In the initial configuration described, the pressers (36) are in the active position, gripping the corner (C) thereof of the film (F) to the related arm (32). Subsequently, the diverters (31) descend towards the lowered position, drawing the film (F) downwards and then unwinding a corresponding portion from the related storage. In the first run portion downwards (from the raised position to the position of FIG. 4), the arms (32) remain in the flanked position. In the second run portion downwards (from FIG. 4 to FIG. 5), the arms (32) move towards the widened position, moving the corners (C) of the film (F) away from each other, up to the lowered position in which the corners (C) are arranged substantially at the quadrilateral vertices (FIG. 5). In this position, the traction device (2) takes charge of the film (F), by means of the gripping units (21), and the pressers (36) return to the inactive position. The gripping units (21) then collect a portion of film (F) of predetermined length, in the manners already described. After the traction device (2) has collected the prefixed portion of film (F), the diverters (31) return to the raised position, again locking the corners (C) of the film (F). Subsequently, the cutting and welding device (4) cuts and welds the film (F) below the feeder device (3), i.e., below the arms (32). From this moment, the diverters (31) return to the raised position, with the pressers (36) in the inactive position, from which it is possible to restart with a new work cycle of the diverters (31) and the machine.

The vertical displacements of the diverters (31) are simultaneous by means of the simultaneous operation of the actuators (31*a*). In an alternative solution, not illustrated, the diverters (31) could be associated with the same structure, and be translated vertically by a single actuator. The operation of the gripping means (33), i.e., the pressers (36), is also simultaneous.

Figure 3:
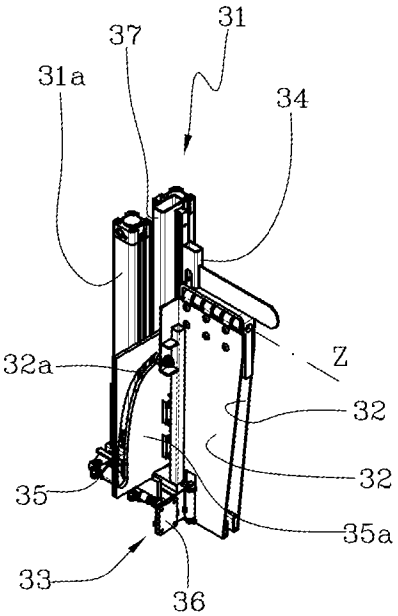

In the embodiment shown, the feeder device (3) comprises two pairs of diverters, i.e., it comprises a second pair of diverters (310) completely analogous to the diverters (31) described above. In essence, the depiction of each diverter of the second pair of diverters (310) is the same as in FIGS. 3,4,5. Each pair of diverters (31,310) is operating on a respective film, coming from a related storage (M1,M2). Depending on which film (F1,F2) must be used, the machine operates the corresponding pair of diverters (31,310). The two pairs of diverters (31,310) are side by side along the horizontal direction (X), i.e., one of the directions along which the feeder device (3) is slidable to move between the working and service positions.

Figure 1:
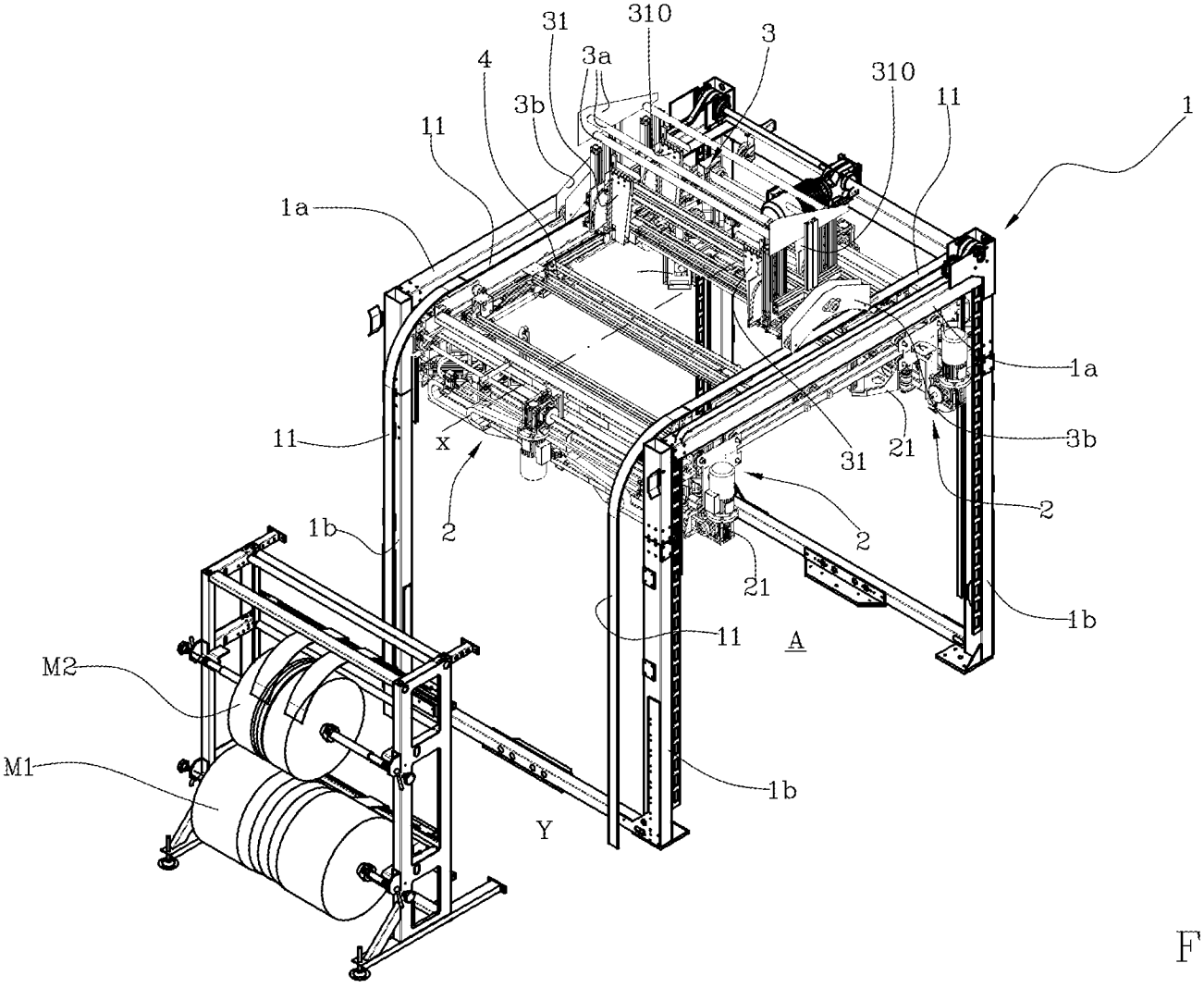
FIG. 1 shows a schematic isometric view of a machine according to the present invention.
Figure 2:
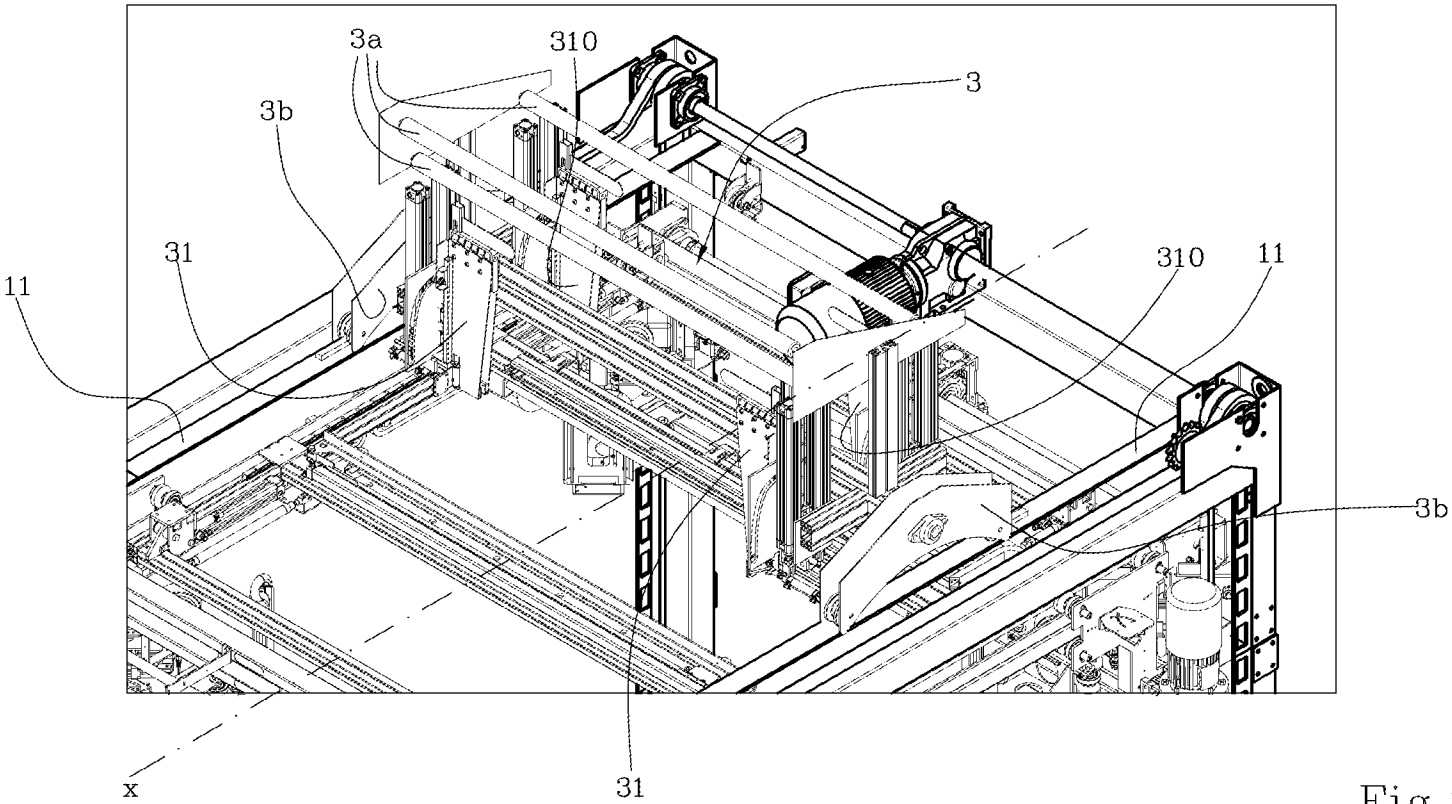
FIG. 2 shows an enlarged area of the machine of FIG. 1.

The feeder device (3) is movable along the frame (1) between a working position (FIGS. 1 and 6), located above the main frame (1), and a service position (FIG. 8), in which the feeder device is located at a given height from the ground, on one side of the main frame (1). In the working position, the feeder device (3) is located above the traction device (2) and feeds the film (F), taking it from a storage (M1, M2, . . . ). In the service position, illustrated in FIG. 8, the feeder device (3) is arranged on a side of the frame (1) at a height which is within easy reach of a person, so that each necessary maintenance or film (F) replacement intervention can be carried out from a ground position.

The feeder device (3) is advantageously movable on an outside area of the main frame (1) and, during the displacement from the working position to the service position, the feeder device (3) is maintained outside of the main frame (1), without cluttering the working area (A). This implies that the feeder device (3) can be brought into the service position regardless of the presence of a pallet or any other object or machinery located in the working area (A), and independently of the position of the traction device (2) and the cutting and welding device (4). For example if the film reel runs out during the course of wrapping a pallet, it is not necessary to remove the pallet from the machine, as is the case with machines available at present, but it is sufficient to shift the feeder device (3) into a service position and associate a new reel of film thereto. This enables significantly reducing the overall height of the machine. On the contrary, other machines at present available have considerable heights for preventing the displacement of the feeder devices from interfering with a pallet present in the machine.

Advantageously, the diverters (31,310), when moving between the working and service positions, are movable on an external area of the main frame (1), along guides (11,12) structured to keep the diverters (31,310) outside the main frame (1) and the working area (A), both in the case where there is only one pair of diverters (31), and in the case where there is a second pair of diverters (310).

In the embodiment shown, the main frame (1) is provided with guides (11,12) extending on an upper portion and a side portion of the main frame (1), on an external part of the main frame (1). The guides (11,12) are structured such as to maintain the diverters (31.310) in a position outside the main frame (1) and the working area (A). In other terms the guides (11,12) are operative on an external part of the main frame (1), in such a way that the diverters (31,310) are always outside the main frame (1) and the working area (A).

The guides (11,12) comprise a first portion (11), associated to an upper portion of the main frame (1), and a second portion (12), associated to a side portion of the main frame (1).

In the upper portion of the main frame (1), the diverters (31) are mobile on the first portion (11) of the guides (11,12) along a first direction (X) which lies on a plane, preferably horizontal or slightly inclined with respect to the horizontal plane. In the side portion of the main frame, the diverters (31) are mobile on the second portion (12) of the guides (11,12) along a second direction (Y) which lies on a different plane from the previous one, preferably vertical or slightly inclined with respect to the vertical plane. The movement of the diverters (31) along the guides (11,12) can be realised for example by means of a chain transmission, of a type well known to the technical expert in the sector and therefore not described in detail. In the embodiment shown, the diverters (31) are associated to a frame (3*a*), provided with sliders (3*b*) sliding along the guides (11,12). The second pair of diverters (310), if present, is also associated to the frame (3*a*).

Figure 6:
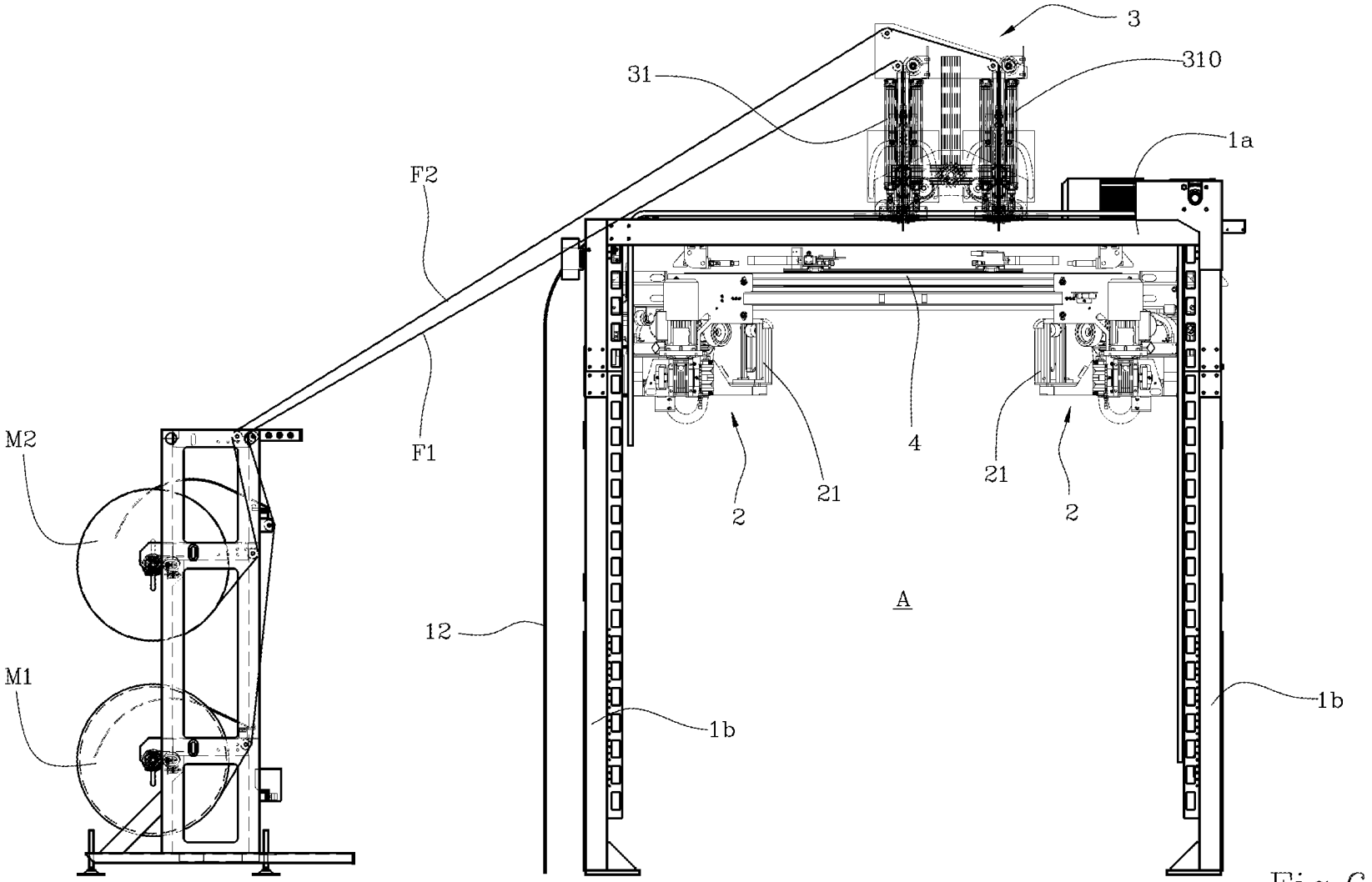
FIGS. 6, 7 and 8 show the machine according to the present invention, in vertical elevation and in three different working configurations.
Figure 7:
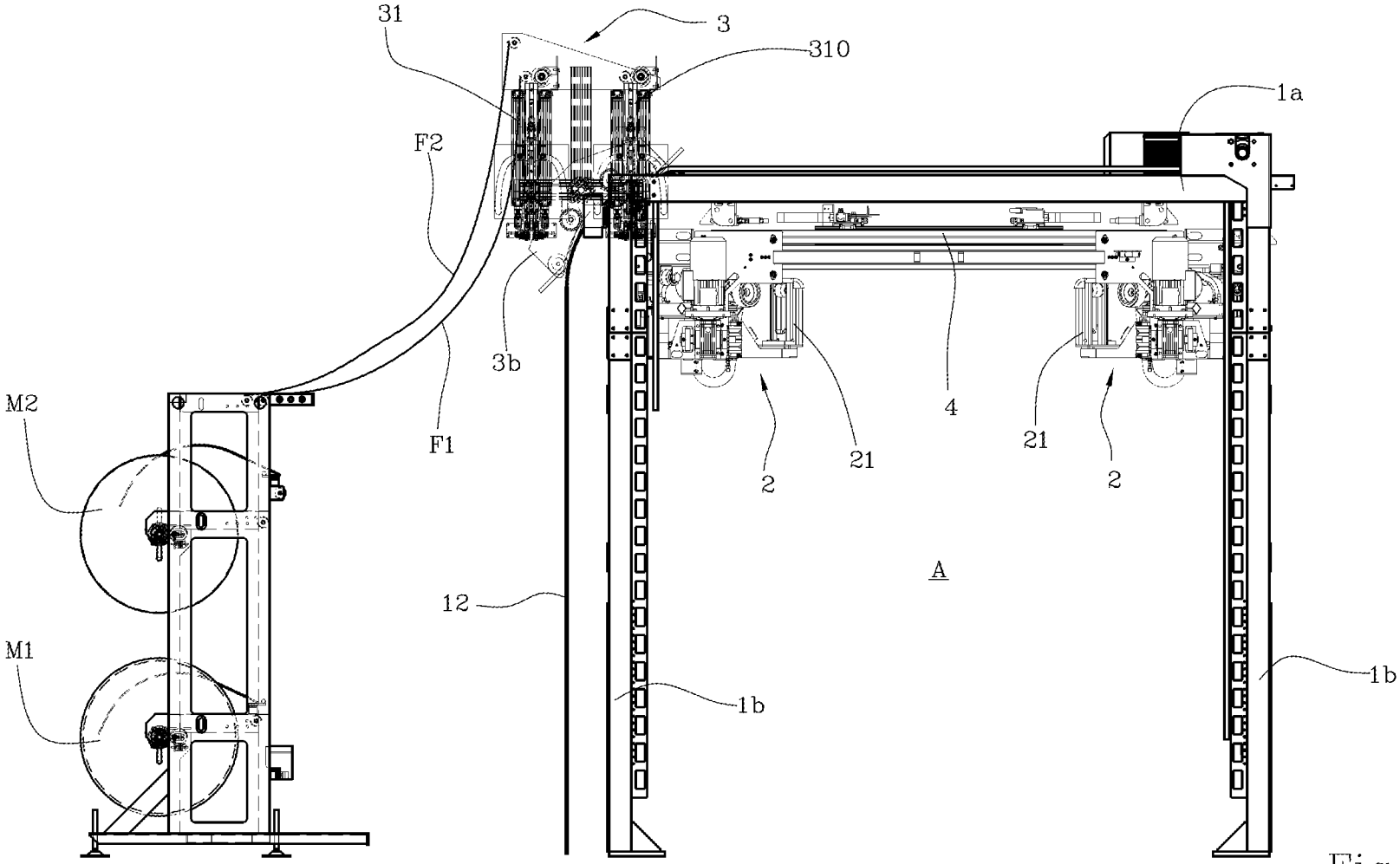
Figure 8:
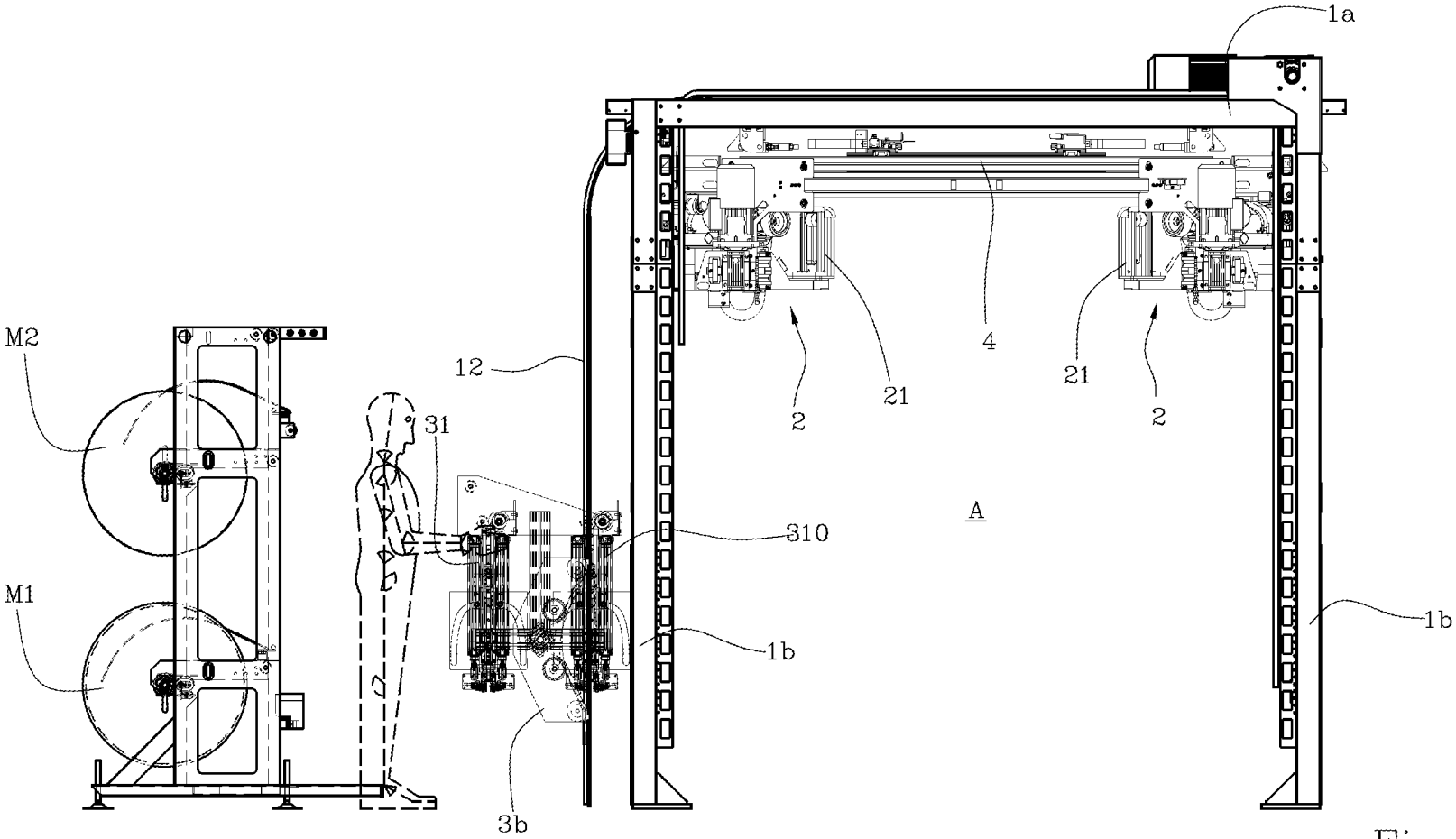

Preferably, the diverters (31,310), moving between the working position and the service position, maintain a constant orientation in space. To this end, the frame (2*a*) is associated with the sliders (2*b*) with the possibility of rotating about a horizontal axis. By means of a kinematic mechanism within the reach of those skilled in the art, or by means of an actuator dedicated to the purpose, the frame (2*a*) rotates with respect to the sliders (2*b*) about a horizontal axis as illustrated in FIGS. 6, 7 and 8, for example to keep the diverters in the same orientation as they have in the working position, or with the gripping means (33) facing downwards.

The guides (11,12) are arranged for example on opposite side areas of the machine frame, i.e., the areas of the frame defined by the uprights (1*b*) and the cross-members (1*a*). The guides (11,12) comprise for example one or more profiled elements, widely known to the technical expert of the sector and therefore not described in detail, along which the diverters (31) are made to slide. In the preferred but non-exclusive embodiment shown, the guides (11,12) comprise a first portion (11), associated to the upper cross-members (1*a*) and a second portion (12), associated to the uprights (1*b*). The first portion (11) is parallel to the first direction (X) and comprises for example a pair of profiled elements parallel to one another and each associated to a cross-member (1*a*). The second portion (12) is parallel to the second direction (Y) and comprises for example a pair of profiled elements parallel to one another and each associated to an upright (1*b*). A connecting sector conjoins the two portions (11,12) of the guides. The sliders (3*b*) of the frame (3*a*) supporting the diverters (31) are movable along the first and second portion (11,12) of the guides (11,12).

The invention claimed is:

1. A machine for wrapping pallets (P) by means of a stretchable film cap made from a tubular film, the machine comprising: a main frame (1) which defines a working area (A) of the machine, wherein said working area (A) of the machine is substantially the space in which the pallet to be wrapped is located and in which the machine carries out the wrapping; a traction device (2), arranged and effective to lower the film cap by fitting it onto the pallet (P); a feeder device (3) arranged to feed the tubular film to the traction device (2); a cutting and welding device (4) of the tubular film, arranged to cut and weld the tubular film so as to obtain the film cap closed at one end thereof;

wherein the tubular film, when provided to the feeder device (3), has a first main layer (S1) and a second main layer (S2), said first and second main layers (S1, S2) being superposed and joined laterally by two side portions, the two side portions being a first side portion and a second side portion, the junction areas between the two side portions and the two main layers (S1, S2) defining first, second, third and fourth corners, the first corner being the junction area of the first main layer (S1) and the first side portion, the second corner being the junction area of the first main layer (S1) and the second side portion, the third corner being the junction area of the second main layer (S2) and the first side portion, the fourth corner being the junction area of the second main layer (S2) and the second side portion;

wherein the feeder device (3) is movable along the main frame (1) between a working position, located above the main frame (1), and a service position, in which said feeder device (3) is located at a given height from the ground, on one side of the main frame (1);

characterised in that:

the feeder device (3) comprises a first diverter (31) and a second diverter (31), the first diverter (31) being structured and effective to grip the first corner and the third corner and to move them away from one another, and the second diverter (31) being structured and effective to grip the second corner and the fourth corner and to move them away from one another, so that a portion of the first main layer (S1) is moved away from a portion of the second main layer (S2);

the first and second diverters (31) are vertically movable between a raised position, in which they grip their respective corners, and a lowered position, in which they release their respective corners, drawing the tubular film for a portion of length as a function of the run from the raised position to the lowered position;

the first and second diverters (31) are movable on an area outside of the main frame (1) along guides (11,12), structured and effective to maintain the feeder device (3) outside the main frame (1) and the working area (A), during the displacement between the working position and the service position.

2. The machine according to claim 1, wherein each diverter (31) comprises a pair of arms (32), each arm (32) provided with a gripping means (33) for gripping a corner of the tubular film, which arms (32) are movable with respect to one another between a widened position, in which they space the corners of the tubular film, and a narrowed position.

3. The machine according to claim 2, wherein the arms (32) of each diverter (31) are hinged to one another at an end.

4. The machine according to claim 3, wherein the main frame (1) comprises one or more upper cross-members (la) and one or more uprights (1*b*) connected to the upper cross-members (la); the guides (11, 12) comprise a first portion (11), associated to the upper cross-members (la) and a second portion (12), associated to the uprights (1*b*).

5. The machine according to claim 2, wherein each gripping means (33) comprises a presser (36), associated to a respective arm (32) and movable between an active position, in which it retains a corner (C) of the tubular film on the arm (32), and an inactive position, in which it does not retain the corner.

6. The machine according to claim 5, wherein the presser (36) is hinged to the arm (32) about an axis of rotation with respect to which it rotates between the active position and the inactive position.

7. The machine according to claim 2, wherein the feeder device (3) is mobile on a first portion (11) of the guides (11, 12) along a first direction (X), and is mobile on a second portion (12) of the guides (11, 12) along a second direction (Y), inclined with respect to the first direction (X).

8. The machine according to claim 1, wherein the guides (11, 12) extend on an upper portion and a side portion of the main frame (1).

9. The machine according to claim 1, wherein the guides (11, 12) comprise a first portion (11), associated to an upper portion of the main frame (1), and a second portion (12), associated to a side portion of the main frame (1).

10. The machine according to claim 1, wherein the diverters (31) are vertically movable between a raised position, in which they are arranged to grip the corners (C) of the tubular film, and a lowered position in which they release the corners.

11. The machine according to claim 10, wherein each diverter (31) comprises a pair of arms (32), each arm (32) provided with a gripping means (33) for gripping a corner of the tubular film, which arms (32) are movable with respect to one another between a widened position, in which they space the corners of the tubular film (F), and a flanked position, in which they can grip the corners of the tubular film (F) when the tubular film is substantially in a flattened configuration.

12. The machine according to claim 11, wherein the arms (32) of each diverter (31) are hinged to one another at an end.

13. The machine according to claim 11, wherein each of the pair of arms (32) is constrained to a respective guide (35) which defines a curved path on a vertical plane, and wherein the paths defined by the two guides (35) are divergent from one another from above downwards.

14. The machine according to claim 11, wherein each gripping means (33) comprises a presser (36), associated to a respective arm (32) and movable between an active position, in which it retains a corner (C) of the tubular film (F) on the arm (32), and an inactive position, in which it does not retain the corner.

15. The machine according to claim 1, comprising a second pair of diverters (310), arranged to operate on a distinct tubular film (F2) with respect to the tubular film (F1) on which the first and second diverters (31) work.

* * * * *